US010845744B2

(12) United States Patent
Ohta

(10) Patent No.: US 10,845,744 B2
(45) Date of Patent: Nov. 24, 2020

(54) FIXING DEVICE AND IMAGE FORMING APPARATUS

(71) Applicant: SHARP KABUSHIKI KAISHA, Sakai (JP)

(72) Inventor: Motoki Ohta, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/661,475

(22) Filed: Oct. 23, 2019

(65) Prior Publication Data

US 2020/0159152 A1 May 21, 2020

(30) Foreign Application Priority Data

Nov. 16, 2018 (JP) ..... 2018-215214

(51) Int. Cl.
*G03G 15/20* (2006.01)

(52) U.S. Cl.
CPC ..... *G03G 15/2064* (2013.01); *G03G 15/206* (2013.01); *G03G 15/2032* (2013.01)

(58) Field of Classification Search
CPC ..... G03G 15/2064; G03G 15/2032; G03G 15/2035; G03G 15/206
See application file for complete search history.

(56) References Cited

U.S. PATENT DOCUMENTS

2009/0123202 A1* 5/2009 Yoshinaga ..... G03G 15/2032 399/329
2009/0208266 A1 8/2009 Namisaki et al.

FOREIGN PATENT DOCUMENTS

CN 101510067 A 8/2009
JP 2009-192758 A 8/2009

* cited by examiner

*Primary Examiner* — Hoang X Ngo
(74) *Attorney, Agent, or Firm* — ScienBiziP, P.C.

(57) ABSTRACT

In a fixing device of an image forming apparatus, a pressure lever includes an engagement recess for holding a pressure release lever at a pressure position where a biasing member is actuated, and the pressure release lever includes an engaging protrusion which can be engaged with the engagement recess. Also, the pressure lever includes a slidable contact portion adjacent to the engagement recess. The pressure releaser is capable of increasing or decreasing biasing intensity of the biasing member as the engagement protrusion is slid along the slidable contact portion by a biasing force of the biasing member between a state in which the pressure releaser is at the pressure position and a state in which the pressure releaser is at a release position for releasing pressure contact.

7 Claims, 6 Drawing Sheets

FIXING DEVICE AND IMAGE FORMING APPARATUS

BACKGROUND OF THE INVENTION

Field of the Invention

The present invention relates to a fixing device that can be applied to an electrophotographic image forming apparatus such as a copying machine or a printer, and to an image forming apparatus.

Description of the Background Art

Electrophotographic image forming apparatuses such as copying machines and printers are configured to charge a rotatively driven photosensitive drum by a charger, form an electrostatic latent image on the photosensitive drum by irradiating light according to image information on the photosensitive drum, attach toner (dry toner) to the electrostatic latent image by a developing device, thereby forming a toner image, and transfer the toner image to a recording medium such as a sheet material or a sheet of paper, thereby outputting an image.

The image forming apparatus is provided with a fixing device which melts and fixes unfixed toner on a recording medium to be conveyed. For such a type of fixing device, a thermal fixing roller system is well known. In the thermal fixing roller system, a pair of roller members including a fixing roller, which uses a halogen lamp or the like as a fixation source, and a pressure roller, are arranged to be opposed to each other at a part for melting and fixing the unfixed toner, and a recording medium is passed through a pressure contact area (fixing nip portion) at which the roller members press the recording medium at a predetermined pressure, causing the toner on the recording medium to be melted and fixed on the recording medium.

A conventional fixing device presents a problem of having partial permanent deformation in an elastic layer formed at an outer periphery of the roller members, which is caused by biasing of the roller members against each other with a pressure member, such as a spring, for a long time. With respect to the above problem, a fixing device disclosed in, for example, Japanese Unexamined Patent Application Publication No. 2009-192758, proposes prevention of partial permanent deformation in the roller members of the fixing device by restricting a pressure operation by way of a pressure member including a pressure lever and a spring member which press the fixing roller and the pressure roller.

There is more room for improvement in the use of the conventional fixing device. For example, when a state in which the pressure roller and the fixing roller are pressed by the pressure member is to be cancelled, a release operation of releasing the pressure lever, which has been biased by the spring member, is carried out by way of a pressure release lever. When the pressure release lever is operated, the pressure release lever may generate a collision sound or an impact sound. Mitigating such an impact sound has been desired so that the pressure release lever can be operated at ease by suppressing vibrations, etc., to be conveyed to each of the members constituting the fixing device.

The present disclosure has been conceived in view of the problems as described above. An object of the present disclosure is to provide a fixing device capable of mitigating an impact sound to be made in cancelling a state of pressure contact between a first fixing member and a second fixing member as the roller members, and an image forming apparatus provided with such a fixing device.

SUMMARY OF THE INVENTION

As the means for solving the problem in order to achieve the above object of the present invention, an aspect of the present invention is a fixing device which includes a first fixing member and a second fixing member that are opposed to each other, a supporter which supports the first fixing member and the second fixing member to be contactable with or separable from each other, a biasing member which biases the supporter in a pressure contact direction, which is a direction in which the first fixing member and the second fixing member are pressed, and a releaser which releases pressure contact between the first fixing member and the second fixing member, in which the releaser moves relatively with respect to the supporter along a predetermined movement direction to actuate the biasing member. Here, the supporter includes an engagement recess which holds the releaser at a pressure position where the biasing member is actuated, and the releaser includes an engagement protrusion which is engageable with the engagement recess. Further, the supporter includes a slidable contact portion adjacent to the engagement recess. Furthermore, an aspect of the present invention is characterized in that the releaser enables biasing intensity of the biasing member to be increased or decreased as the engagement protrusion is slid along the slidable contact portion by a biasing force of the biasing member between a state in which the releaser is at the pressure position and a state in which the releaser is at a release position for releasing the pressure contact, the slidable contact portion includes a first flat portion extending in a direction of reducing the biasing force of the biasing member, a neutral portion which is contiguous with the first flat portion and at which the biasing force of the biasing member is minimized, and a second flat portion extending further beyond the neutral portion, and an angle formed between the first flat portion and the second flat portion is an obtuse angle or a straight angle.

More specifically, in the fixing device having the above-described structures, an aspect in which the slidable contact portion holds the releaser at the release position in the neutral portion can be exemplified. Also, in the fixing device having the above-described structures, an aspect in which the first flat portion is provided between the engagement recess and the neutral portion, and is inclined in a direction of reducing the biasing force of the biasing member is exemplified.

Moreover, in the fixing device having the above-described structures, an aspect in which the second flat portion is provided continuously to be successive to the first flat portion and the neutral portion, and is inclined in a direction of increasing the biasing force of the biasing member is exemplified.

Further, in the fixing device having the above-described structures, an aspect in which the second flat portion is provided with a flat surface that is greater in length than a flat surface between the engagement recess and the neutral portion is exemplified.

Furthermore, in the fixing device having the above-described structures, an aspect in which the second flat portion includes an extension portion projected from an end portion of the supporter, and extending in a direction of being away from the first fixing member and the second fixing member is exemplified.

As the means for solving the problem in order to achieve the above object of the present disclosure, an image forming apparatus provided with a fixing device having the above-described structures is also within the scope of the technical concept of the present disclosure.

Since the present disclosure is configured as described above, it is possible to provide a fixing device capable of mitigating an impact sound to be made in cancelling a state of pressure contact between the first fixing member and the second fixing member, and also an image forming apparatus provided with such a fixing device.

DESCRIPTION OF THE PREFERRED EMBODIMENTS

Hereinafter, a fixing device and an image forming apparatus according to an embodiment of the present disclosure will be described with reference to the drawings.

Image Forming Apparatus

Figure 1:
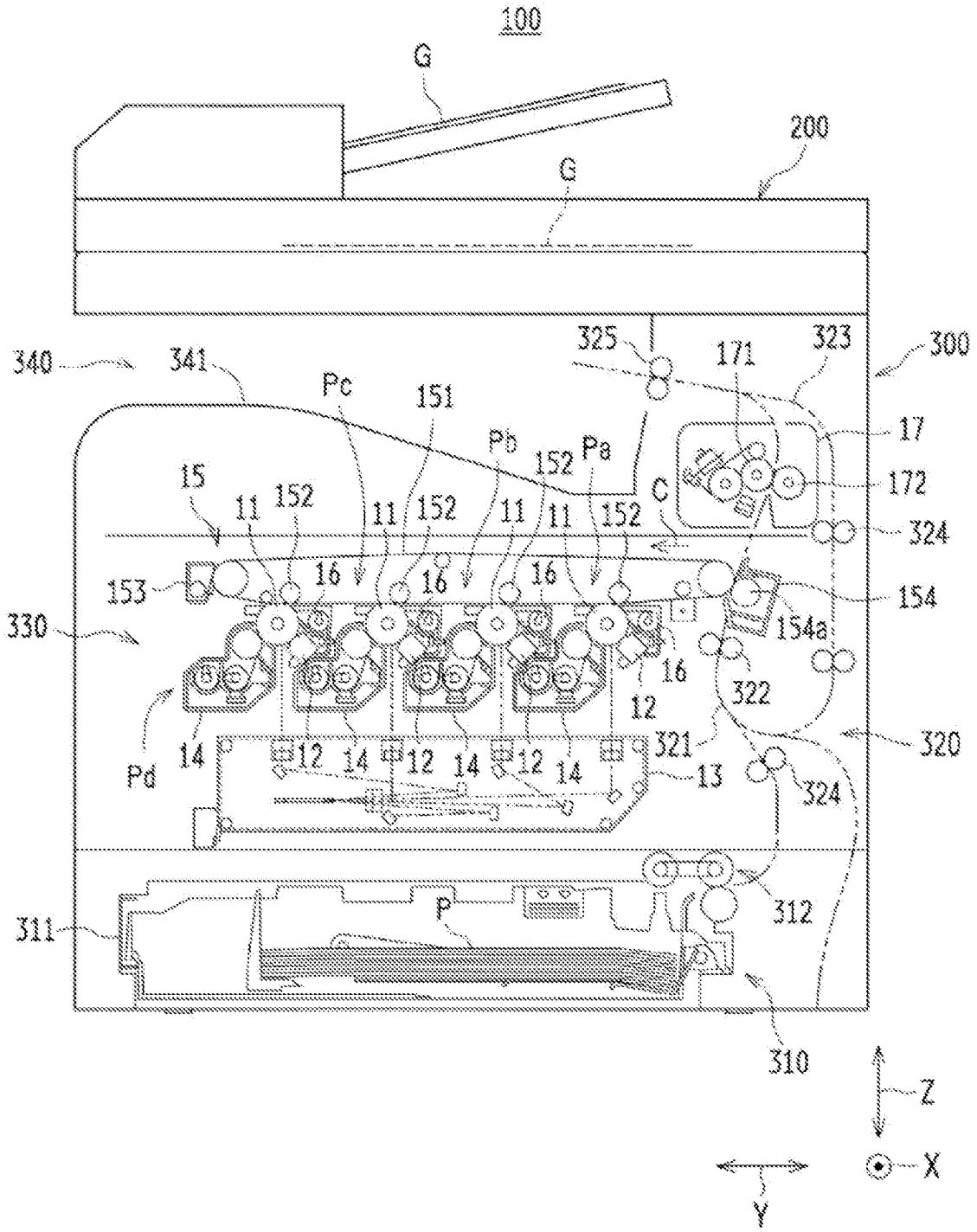
FIG. 1 is a schematic cross-sectional view of an image forming apparatus including a fixing device according to the present disclosure.

FIG. 1 is a schematic cross-sectional view of an image forming apparatus including a fixing device according to Embodiment 1 of the present invention. In FIG. 1 (and FIGS. 2 to 4 which will be described later), reference symbol X represents a depth direction along a horizontal direction, reference symbol Y represents a width direction along a horizontal direction which is orthogonal to the depth direction X, and reference symbol Z represents an up-and-down direction (vertical direction) orthogonal to the horizontal direction, respectively.

An image forming apparatus 100 has a copy function of reading an image of a document G, and forming an image on a recording sheet P such as recording paper. The image forming apparatus 100 includes an image reading apparatus 200 which reads an image of the document G, and a body part 300 of the image forming apparatus 100 which forms an image on the recording sheet P.

The body part 300 includes a sheet feeder 310, a sheet conveyor 320, an image former 330, and a sheet discharger 340. Image data dealt with in the image former 330 is assumed to be data according to a color image using respective colors of black (K), cyan (C), magenta (M), and yellow (Y), or data according to a monochrome image using a single color (for example, black).

In the image former 330, four sets of a photosensitive drum 11, a charger 12, a developing device 14, an intermediate transfer roller 152 of a transfer device 15, and a drum cleaning device 16 are provided to form four types of images corresponding to each color. That is, each of the aforementioned elements is made to correspond to one of black, cyan, magenta, and yellow. In the example illustrated in FIG. 1, the same reference numerals are assigned to members having substantially common structures in four image stations Pa, Pb, Pc, and Pd.

In forming an image, in the body part 300, the photosensitive drum 11 is rotated while circularly moving an intermediate transfer belt 151 of the transfer device 15 in a direction indicated by arrow C, and the surface of the photosensitive drum 11 is uniformly charged to a predetermined potential by the charger 12. Also, the surface of the photosensitive drum 11 is exposed to light by an optical scanning device 13 to form an electrostatic latent image on the surface. Further, the electrostatic latent image on the surface of the photosensitive drum 11 is developed by the developing device 14 to form a toner image (unfixed image) on the surface of the photosensitive drum 11. In this way, a toner image of each color is formed on the surface of the photosensitive drum 11. Then, residual toner on the surface of the photosensitive drum 11 is removed and collected by the drum cleaning device 16.

While circularly moving the intermediate transfer belt 151 in the direction indicated by arrow C, the toner images of respective colors formed on the surfaces of the photosensitive drums 11 are sequentially transferred and superimposed on the intermediate transfer belt 151 by the intermediate transfer roller 152 to which a transfer bias is applied. A colored toner image is thus formed on the intermediate transfer belt 151. In this way, a colored toner image is formed on the surface of the intermediate transfer belt 151. Then, residual toner on the surface of the intermediate transfer belt 151 is removed and collected by a belt cleaning device 153.

The sheet feeder 310 draws, from a paper feed cassette 311, the recording sheet P stacked on the paper feed cassette 311 by a sheet feed roller portion 312, and conveys the recording sheet P to the image former 330 through a sheet conveyance path 321 of the sheet conveyor 320. The sheet conveyance path 321 is provided with resist rollers 322, each pair of conveyance rollers 324, and discharge rollers 325.

The resist rollers 322 temporarily stop the recording sheet P and align an edge of the recording sheet P. After that, the resist rollers 322 start conveyance of the recording sheet P according to the transfer timing of the colored toner image in a transfer nip area between the intermediate transfer belt 151 and a transfer roller 154*a* of a secondary transfer device 154.

The recording sheet P conveyed from the sheet feeder 310 to the image former 330 through the sheet conveyance path 321 of the sheet conveyor 320 is continued to be conveyed while being sandwiched in the transfer nip area between the intermediate transfer belt 151 and the transfer roller 154*a*. In addition, the colored toner image on the surface of the intermediate transfer belt 151 is transferred onto the recording sheet P by the transfer roller 154*a* to which the transfer bias is applied. Then, the recording sheet P is heated and pressed by being sandwiched between a fixing roller 171 and a pressure roller 172 of a fixing device 17, and the colored toner image on the recording sheet P is fixed. Further, the recording sheet P is conveyed toward the sheet discharger 340, and is discharged to a discharge tray 341 of the sheet discharger 340 via the discharge rollers 325.

When image formation is to be performed not only on a front surface of the recording sheet P, but also on a back surface, the recording sheet P having the toner image fixed to the front surface of the recording sheet P by the fixing device 17 is conveyed in the reverse direction toward a reverse path 323 by the discharge roller 325. Then, the front and back of the recording sheet P is reversed by the reverse path 323, and the recording sheet P is guided to the resist rollers 322 again. Then, as has been done on the front surface of the recording sheet P, a toner image is formed on the back surface of the recording sheet P and fixed, and the recording sheet P is discharged to the discharge tray 341 of the sheet discharger 340.

Fixing Device

Embodiment 1

Figure 2:
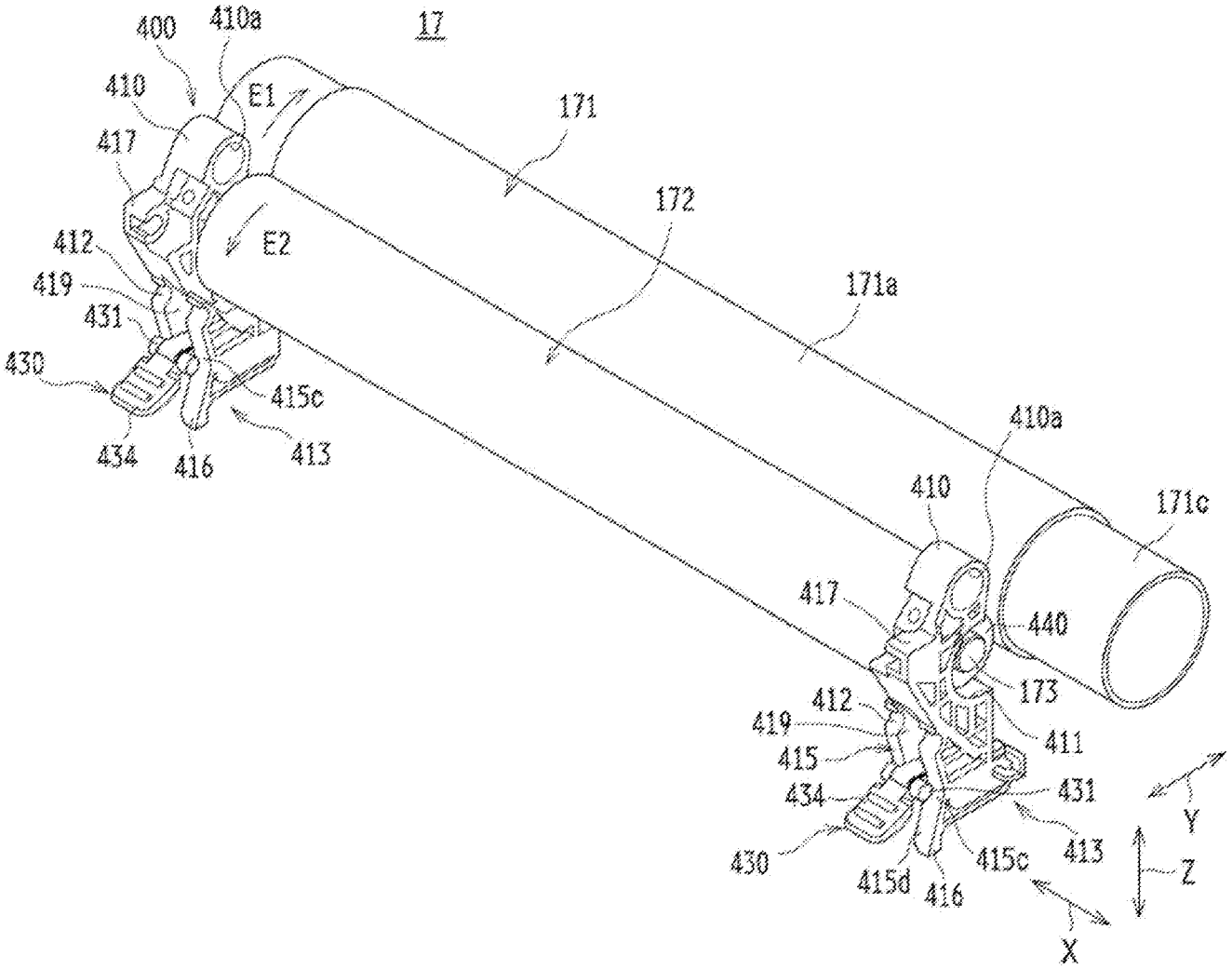
FIG. 2 is a perspective view schematically showing the essential part of a fixing device according to Embodiment 1.
Figure 3:
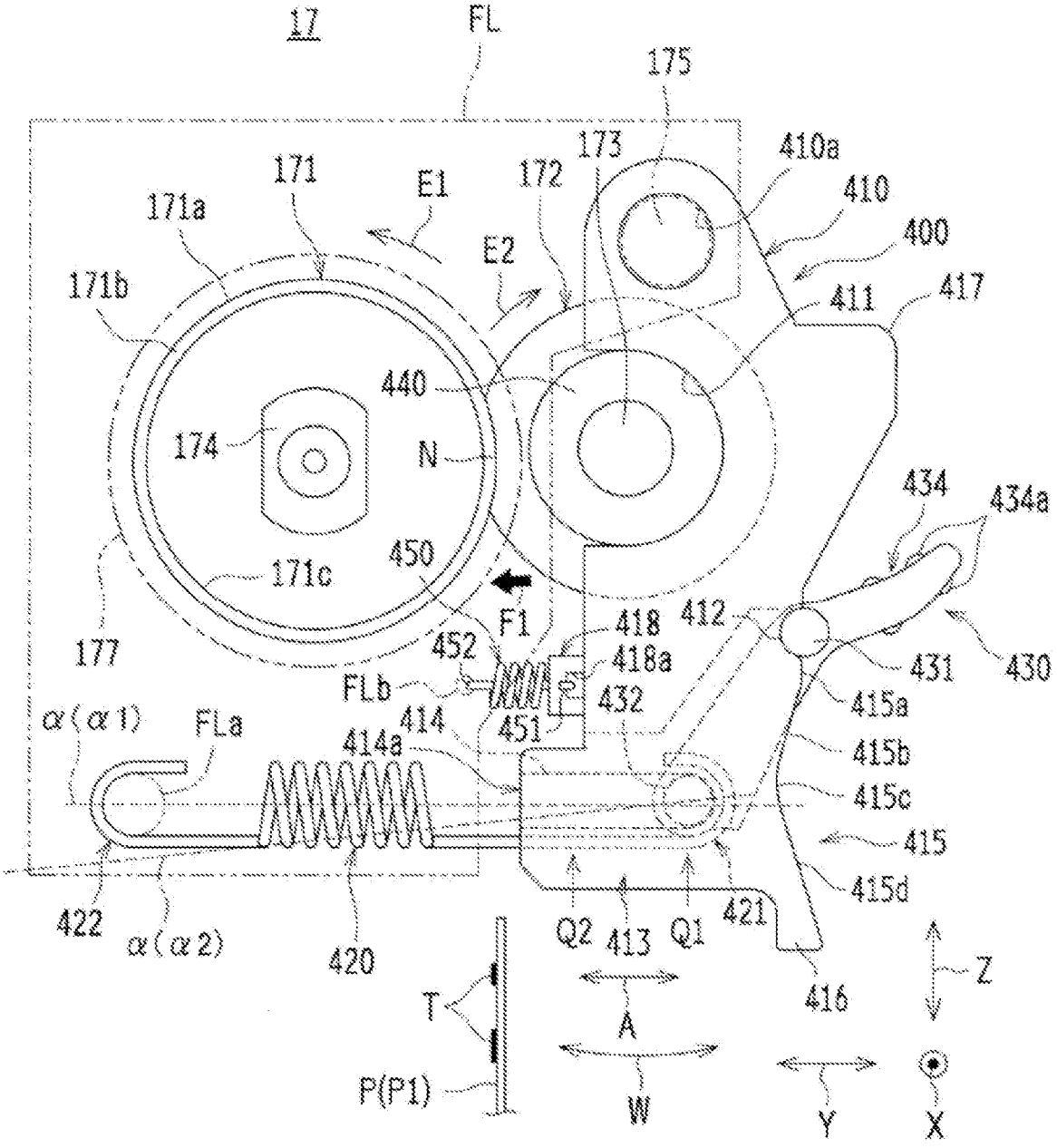
FIG. 3 is a schematic front view of the fixing device shown in FIG. 2, and illustrates a pressure contact state in which a pressure roller is pressed against a fixing roller.
Figure 4:
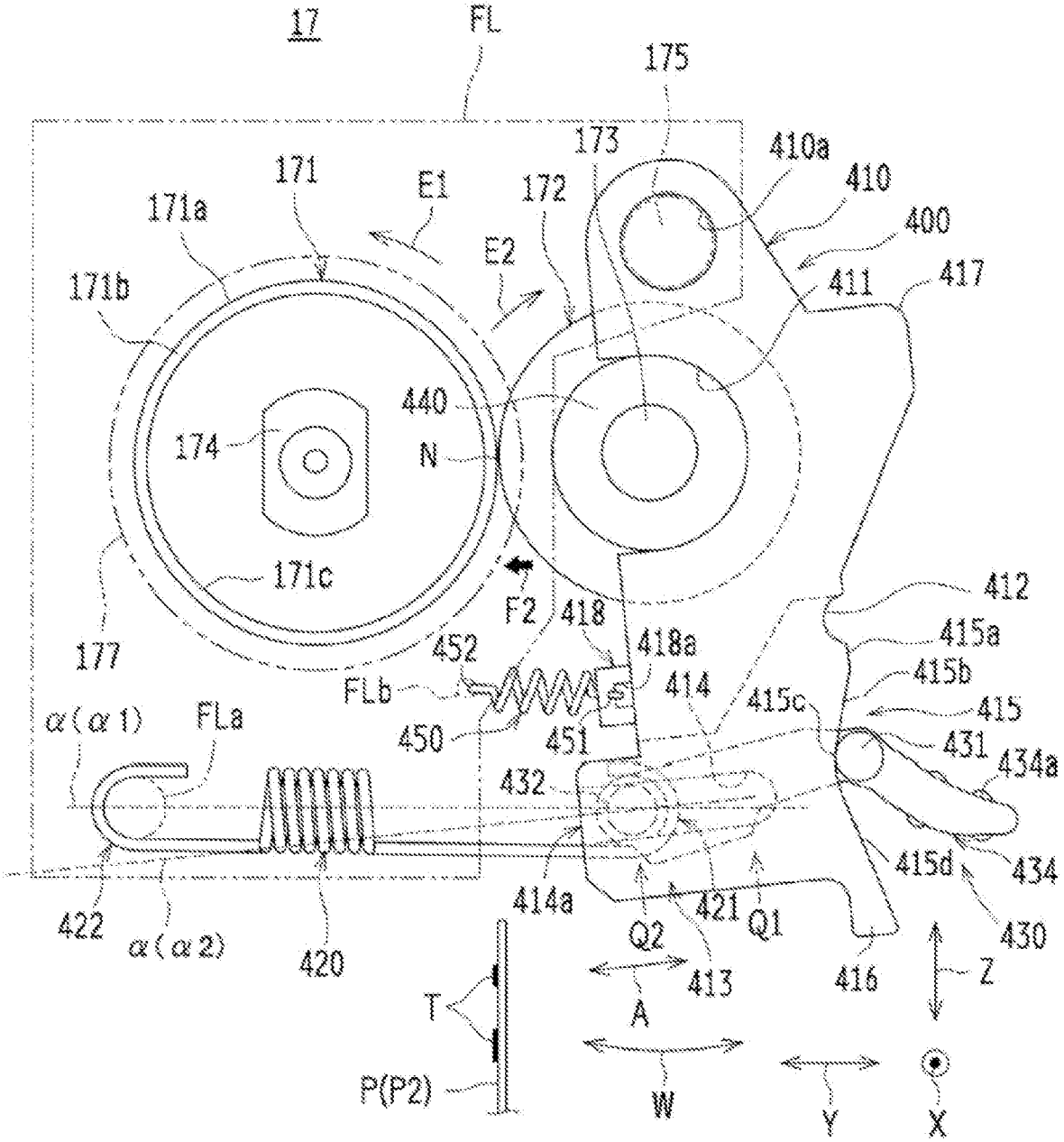
FIG. 4 is a schematic front view of the fixing device shown in FIG. 2, and illustrates a pressure release state in which the pressure contact of the pressure roller on the fixing roller is released.

FIG. 2 is a perspective view schematically showing the essential part of the fixing device 17 according to Embodiment 1 of the present invention, and illustrates a pressure contact state of the pressure roller 172 on the fixing roller 171. FIGS. 3 and 4 are schematic front views of the fixing device 17 shown in FIG. 2. Of the above figures, FIG. 3 shows the pressure contact state in which the pressure roller 172 is pressed against the fixing roller 171, and FIG. 4 shows a pressure release state in which the pressure contact of the pressure roller 172 on the fixing roller 171 is released.

Note that illustration on one side of the fixing device 17 in the depth direction X is substantially the same as that on the other side except that the right and left are reversed. Therefore, FIGS. 2 to 4 illustrate only one side in the depth direction X. Also, in FIG. 2, a body frame FL is omitted from the illustration.

As shown in FIGS. 3 and 4, the fixing device 17 includes the fixing roller 171 (an example of a first fixing member) for fixing a toner image (an unfixed image formed of toner T) on the recording sheet P, the pressure roller 172 (an example of a second fixing member) which is opposed to the fixing roller 171, and a pressure contact device 400 which can press the pressure roller 172 against the fixing roller 171 and also release the pressure contact of the pressure roller 172 on the fixing roller 171.

The fixing device 17 forms a fixing nip area (fixing nip portion) N between the fixing roller 171 and the pressure roller 172 in a state in which the fixing roller 171 and the pressure roller 172 are pressed against each other by the pressure contact device 400.

In the present embodiment, the fixing roller 171 includes a heat source 174 such as a halogen heater lamp, and a roller surface 171*a* is heated by the heat source 174.

As shown in FIGS. 3 and 4, in the fixing roller 171, a rotary shaft 171*b* is rotatably provided on the body frame FL of the fixing device 17. The fixing roller 171 includes a cylindrical cored bar 171*c*, and is disposed on the toner T side on the recording sheet P being conveyed. The heat source 174 is provided on the inner side of the cored bar 171*c* of the fixing roller 171.

Thereby, in the fixing roller 171, the roller surface 171*a* is heated by the heat source 174, and the heat of the roller surface 171*a* is conducted to the toner T on the recording sheet P. Further, while the fixing roller 171 holds the recording sheet P in the fixing nip area N between the pressure roller 172 and the fixing roller 171 in a state in which the fixing roller 171 is pressed on the pressure roller 172 with the recording sheet P interposed therebetween, the fixing roller 171 thermally fixes the toner T on the recording sheet P together with the pressure roller 172. In the present embodiment, although no heat source is provided in the pressure roller 172, the pressure roller 172 may be provided with a heat source.

In a state in which the fixing device 17 having the above-described configuration is mounted in the body part 300 (FIG. 1) of the image forming apparatus 100, a drive mechanism (not shown) such as a gear at the body part 300 meshes with a gear (not shown) provided on the rotary shaft 171*b* of the fixing roller 171. A rotation drive force from the drive mechanism at the body part 300 is transmitted to the rotary shaft 171*b* of the fixing roller 171 via the gear. The fixing roller 171 is rotationally driven in a predetermined rotational direction E1.

The pressure roller 172 rotates accordingly in a rotational direction E2 opposite to the rotational direction E1 of the fixing roller 171 in accordance with the rotation of the fixing roller 171. The recording sheet P is conveyed while being sandwiched between the fixing roller 171 and the pressure roller 172, and is heated and pressed in the fixing nip area N. Thereby, unfixed toner T on the recording sheet P is melted, mixed, and pressed to be thermally fixed.

Pressure Contact Device

The pressure contact device 400 includes a pressure lever 410 (an example of a supporter) which supports the pressure roller 172 in such a way that the pressure roller 172 can be in contact with or separated from the fixing roller 171, a first pressure contact spring 420 (an example of a biasing member) such as a coil spring which biases the pressure lever 410 such that the pressure roller 172 is pressed against the fixing roller 171, and a pressure release lever 430 (an example of a pressure releaser) which releases the pressure contact of the pressure roller 172 on the fixing roller 171.

The above description "can be in contact with or separated from" is intended to express that the pressure roller 172 can be moved in a direction in which the pressure roller 172 approaches the fixing roller 171 and a direction in which the pressure roller 172 moves away from the fixing roller 171.

In the present embodiment, as shown in FIGS. 3 and 4, the pressure lever 410 pivotably supports the pressure roller 172 in a contacting/separating direction W relative to the fixing roller 171 such that pivoting is performed about a pivoting axis (more specifically, a pivoting fulcrum 175) along a rotary shaft 173 of the pressure roller 172. It is assumed that the contacting/separating direction W is a direction in which the pressure roller 172 is pressed and a direction in which the pressure contact of the pressure roller 172 is released.

The pressure lever 410 rotatably supports the rotary shaft 173 of the pressure roller 172, and is provided to be pivotable about the pivoting fulcrum 175. It is assumed that the pivoting fulcrum 175 is a fulcrum pin constituting a pivoting shaft fixed to the main body of the fixing device 17 (specifically, the body frame FL) along the rotary shaft 173 of the pressure roller 172. The pressure lever 410 is provided at both end portions of the rotary shaft 173 of the pressure roller 172.

Each of a pair of pressure levers 410 as described above includes a receiving portion 411 which receives the rotary shaft 173 on both sides of the pressure roller 172. The pair of pressure levers 410 rotatably supports the rotary shaft 173 at the both end portions of the pressure roller 172 via respective bearings 440 of the receiving portions 411.

At one end portion of the pressure lever 410 in a predetermined direction, an engagement portion 410*a* in which the pivoting fulcrum 175 is pivotably engaged is provided. In the examples illustrated in FIGS. 3 and 4, the engagement portion 410*a* is provided above the pressure roller 172. The engagement portion 410*a* is a through-hole, and allows the pivoting fulcrum 175 to be inserted therein pivotably.

The pressure release lever 430 is attached to the pair of pressure levers 410 respectively. The pair of pressure release levers 430 provided as described above, the first pressure contact spring 420 is provided respectively.

As shown in FIGS. 3 and 4, the pressure contact device 400 is configured such that the pressure release levers 430 are moved relatively along a predetermined movement direction A, which has been defined in advance, with respect to the pair of pressure levers 410, to actuate a pair of first pressure contact springs 420.

The pressure contact device 400 relatively moves the pressure release lever 430 with respect to the pressure lever 410 on a virtual line (i.e., a virtual straight line α, broken lines α1 and α2 in FIGS. 3 and 4) along the movement direction A. Note that the movement direction A is a concept covering an arc-like direction and a wave-like direction other than a linear direction. Thus, as an example, the virtual line along the movement direction A may be a virtual are along the arc-like direction or a virtual wavy line along the wave-like direction other than the virtual straight line.

As shown in FIG. 3, the pressure lever 410 includes an engagement recess 412, which holds the pressure release lever 430 at a pressure position Q1 where the first pressure contact spring 420 is actuated in the movement direction A. In this case, the pressure lever 410 is provided with the engagement recess 412 to hold the pressure release lever 430 at the pressure position Q1 where a biasing force produced by the first pressure contact spring 420 on the virtual straight line α comes into effect. The engagement recess 412 is provided on a side surface of the pressure lever 410 on the opposite side of the fixing roller 171, and is formed in a curved shape which is depressed as a recess.

More specifically, the engagement recess 412 has a semi-cylindrical curved shape, and the radius of curvature of the engagement recess 412 is made substantially the same as the radius of an engagement protrusion 431 of the pressure release lever 430. The engagement recess 412 is formed such that the engagement recess 412 can reliably engage the engagement protrusion 431 while ensuring a sufficient area of contact with the engagement protrusion 431.

Each of the pressure release levers 430 of the pair includes the engagement protrusion 431 which can be engaged with the engagement recess 412 of the pressure lever 410. As shown in FIG. 3, the engagement protrusion 431 is provided in a protruding shape along an orthogonal direction (depth direction X) orthogonal to the movement direction A (virtual straight line α direction).

FIG. 3 shows the state in which the engagement protrusion 431 is engaged with the engagement recess 412 of the pressure lever 410. In such a state, the pair of first pressure contact springs 420 applies a biasing force to the pair of pressure levers 410, and presses the pressure roller 172 against the fixing roller 171.

Moreover, the pressure release lever 430 includes a shaft part 432 along the orthogonal direction (depth direction X), which is orthogonal to the movement direction A (virtual straight line α direction). The shaft part 432 is provided on one of end portions of the pressure release lever 430. Further, an end portion on the other side of the pressure release lever 430 is provided with a knob portion 434 for operating the pressure release lever 430.

For the pressure release lever 430 having the above-described configuration, each of the pressure levers 410 includes a guide portion 413 which supports the shaft part 432 of the pressure release lever 430 to be movable in a reciprocating way along the movement direction A (virtual straight line α direction). In the pressure lever 410, the guide portion 413 is provided on an end portion opposite to the pivoting fulcrum 175 with the pressure roller 172 interposed therebetween.

The guide portion 413 includes a guide groove 414 which guides the shaft part 432 of the pressure release lever 430 to be movable along the movement direction A. The guide groove 414 is open to the outside, and includes an opening 414*a* into which the shaft part 432 of the pair of pressure release levers 430 is detachably inserted. In the guide portion 413 of the pressure lever 410, the shaft part 432 of the pressure release lever 430 reciprocates along the movement direction A.

The shaft part 432 of the pressure release lever 430 can be easily attached to and detached from the guide groove 414 of the guide portion 413. As a result, assembling workability of the shaft part 432 of the pressure release lever 430 and the guide portion 413 is enhanced. In the pressure lever 410, the guide portion 413 supports the shaft part 432 of the pressure release lever 430 to be pivotable about the central axis.

As shown in FIGS. 3 and 4, one end portion 421 of the first pressure contact spring 420 is provided on the shaft part 432 of the pressure release lever 430, and the other end portion 422 of the first pressure contact spring 420 is provided on a body-side member FLa of the fixing device 17. Also, the other end portion 422 of the first pressure contact spring 420 is located on the virtual straight line α (α1) in a pressure contact state of the pressure roller 172 on the fixing roller 171.

Note that the one end portion 421 and the other end portion 422 of the first pressure contact spring 420 refer to portions where force is uniformly applied (specifically, portions passing through the center line along the longitudinal direction of the first pressure contact spring 420).

For the pressure release operation of the pressure release lever 430, the pressure lever 410 is provided with a slidable contact portion 415 adjacent to the engagement recess 412. As shown in FIGS. 3 and 4, the slidable contact portion 415 is provided smoothly and continuously from the engagement recess 412, and is formed to slidably move the engagement protrusion 431.

As shown in FIG. 2, the engagement protrusion 431 of the pressure release lever 430 is formed to be a cylindrical protrusion protruding on both sides. In contrast, the slidable contact portion 415 is provided on a side surface of the pressure lever 410 on the opposite side of the fixing roller 171, along the up-and-down direction Z. The pressure lever 410 includes a slit portion which movably holds the pressure release lever 430 at the inner side at a portion including the slidable contact portion 415. The slidable contact portions 415 are arranged in parallel as split pieces with a slit portion 419 sandwiched therebetween in the depth direction X.

Each of the slidable contact portions 415 includes a first flat portion 415*b* extending in a direction of reducing the biasing force of the first pressure contact spring 420, a neutral portion 415*c* which is contiguous with the first flat portion 415*b* and at which the biasing force of the first pressure contact spring 420 is minimized, and a second flat portion 415*d* extending further beyond the neutral portion 415*c*. Further, in the example shown in FIG. 3, a flat connection portion 415*a* is provided between the engagement recess 412 and the first flat portion 415*b*. The slidable contact portion 415 is provided such that the engagement recess 412, the connection portion 415*a*, the first flat portion 415*b*, the neutral portion 415*c*, and the second flat portion 415*d* are arranged from the upper side to the lower side in this order in the up-and-down direction Z.

The first flat portion 415*b* is provided between the connection portion 415*a* contiguous with the engagement recess 412 and the neutral portion 415*c*. The first flat portion 415*b* is formed to be a smooth inclined surface inclined in a direction of reducing the biasing force of the first pressure contact spring 420.

The second flat portion 415*d* is provided on a side away from the engagement recess 412 on the slidable contact portion 415, and is formed to be a smooth inclined surface inclined in a direction of increasing the biasing force of the first pressure contact spring 420. The second flat portion 415*d* is provided continuously to be successive to the first flat portion 415*b* and the neutral portion 415*c*.

The neutral portion 415*c* provided between the first flat portion 415*b* and the second flat portion 415*d* is formed to be curved, and has a shape which smoothly connects between the first flat portion 415*b* and the second flat portion 415*d*. As shown in FIG. 3, when viewed from one side in the depth direction X, the slidable contact portion 415 has a linear outer shape substantially parallel to the up-and-down direction Z at the connection portion 415*a*. The slidable contact portion 415 is most depressed at the neutral portion 415*c* to have the outer shape that is recessed inwardly in the pressure lever 410. Further, each of the first flat portion 415*b* and the second flat portion 415*d* of the slidable contact portion 415 has a linear outer shape inclined toward the neutral portion 415*c*. The neutral portion 415*c* is formed at a position for holding the pressure release lever 430 at a release position Q2.

In the slidable contact portion 415 as described above, the second flat portion 415*d* is provided to have a flat surface that is greater in length than a flat surface (i.e., a slide contact distance of the engagement protrusion 431) between the engagement recess 412 and the neutral portion 415*c*. The first flat portion 415*b* and the second flat portion 415*d* are formed to be flat inclined surfaces that are free of irregularities or undulations in the middle of the first and second flat portions.

Also, the second flat portion 415*d* includes an extension portion 416 projected from a lower end portion of the pressure lever 410. The extension portion 416 is formed as a protruding portion extending in a direction of being away from the fixing roller 171 and the pressure roller 172 at the lower end portion of the pressure lever 410. Further, a side surface of the pressure lever 410 on the opposite side of the fixing roller 171 constitutes a part of the second flat portion 415*d*. By such a configuration, a slide contact distance between the neutral portion 415*c* and a lower end portion of the second flat portion 415*d* is to be sufficiently long as compared to a slide contact distance between the neutral portion 415*c* and the connection portion 415*a*.

In the present embodiment, the pressure lever 410 is formed such that an angle formed between the first flat portion 415*b* and the second flat portion 415*d* in the slidable contact portion 415 becomes an obtuse angle, and the neutral portion 415*c* is provided in a middle portion between the first flat portion 415*b* and the second flat portion 415*d*. In the examples shown in FIGS. 3 and 4, the angle formed between the first flat portion 415*b* and the second flat portion 415*d* is 160°, and the angle should preferably be an obtuse angle in the range of 140° to 170°.

The slidable contact portion 415 which has been formed as described above allows the engagement protrusion 431 to slide by the biasing force of the first pressure contact spring 420 between a state in which the pressure release lever 430 is at the pressure position Q1 and a state in which the pressure release lever 430 is at the release position Q2.

The pressure lever 410 engages the engagement protrusion 431 onto the engagement recess 412 with the pressure release lever 430 positioned at the pressure position Q1. That is, as shown in FIG. 3, the engagement recess 412 of the pressure lever 410 is to engage the engagement protrusion 431 when the pressure release lever 430 is in the state of the pressure position Q1. The engagement protrusion 431 is stably held in the engagement recess 412 of the pressure lever 410. Also, in a state in which the pair of pressure release levers 430 is at the release position Q2, the biasing force applied to the pressure lever 410 by the pair of first pressure contact springs 420 is released.

When the shaft part 432 of the pressure release lever 430 reciprocates along the movement direction A (virtual straight line α direction) in the guide portion 413 of the pair of pressure levers 410, the engagement protrusion 431 of the pressure release lever 430 moves along the slidable contact portion 415 of the pressure lever 410 while being in contact with the slidable contact portion 415. As described above, the slidable contact portion 415 is smoothly connected from the first flat portion 415*b* to the second flat portion 415*d*, and has no irregularities or undulations in the middle. Therefore, the engagement protrusion 431 can be slid extremely smoothly without causing collision or the like.

The pressure release lever 430 is provided with the knob portion 434 on a side opposite to the shaft part 432 with the engagement protrusion 431 interposed therebetween. The shape of the knob portion 434 to be provided is not limited. However, in the present embodiment, the pressure release lever 430 is formed in such a shape that the shaft part 432 side and the knob portion 434 side are bent at the part of the engagement protrusion 431. Further, the knob portion 434 is curved from the engagement protrusion 431 to a distal end portion, and has a shape that is leaped upward in the up-and-down direction Z in a state of being engaged onto the engagement recess 412. Consequently, a configuration for enabling the user to grip the knob portion 434 to facilitate the operation is achieved. Further, by providing a plurality of protrusions 434*a* on the upper and lower surfaces of the knob portion 434, slipping of the fingers is prevented, and the operability is enhanced.

The pressure release lever 430 is provided in such a state that the pressure release lever 430 is held in the slit portion 419 of the pressure lever 410, and a portion from the engagement protrusion 431 to the knob portion 434 protrudes outward from the pressure lever 410. A cleaning roller (not shown) which cleans the surface of the pressure roller 172 is pressed against the pressure roller 172. The pressure lever 410 includes a protruding support portion 417 provided on a side opposite to the fixing roller 171, and protruding in the movement direction A. The cleaning roller is supported on the protruding support portion 417 parallel to the pressure roller 172, and is pressed toward the pressure roller 172. The protruding support portion 417 also serves as a protruding gripper to be gripped by the user.

As shown in FIG. 3, when the pressure release lever 430 is at the pressure position Q1, the knob portion 434 is in an upward posture with the distal end portion facing obliquely upward in the up-and-down direction Z. Also, as shown in FIG. 4, when the pressure release lever 430 is at the release position Q2, the knob portion 434 is in a downward posture with the distal end portion facing obliquely downward in the up-and-down direction Z.

In the present embodiment, it is assumed that the pair of first pressure contact springs 420 is in a free length (natural length) state when the pair of pressure release levers 430 is at the release position Q2. As the first pressure contact spring 420 is in the free length state when the pressure release lever 430 is at the release position Q2, in mounting each of the first pressure contact spring 420 to be between the pressure release lever 430 side and the fixing roller 171 side, it is not necessary to exert strong pressure to mount the first pressure contact spring 420. That is, it is possible to manually mount the first pressure contact spring 420 without using a tool, for example.

As shown in FIGS. 3 and 4, the fixing device 17 includes a pair of second pressure contact springs 450 serving as sub-biasing members. An engagement portion 418*a* is provided at a peripheral portion of the pressure roller 172 on the opposite side of the pivoting fulcrum 175 of the pressure lever 410 with the pressure roller 172 interposed therebetween. The engagement portion 418*a* is formed as a mounting hole provided in a mounting portion 418, specifically. An engagement hole FLb is provided on the body frame FL of the fixing device 17. While one end 451 of each of the second pressure contact springs 450 of the pair is engaged with the engagement portion 418*a*, the other end 452 of each of the second pressure contact springs 450 of the pair is engaged with the engagement hole FLb of the body frame FL of the fixing device 17.

Explanation of Pressure Release

By the pressure release lever 430, when the engagement between the engagement protrusion 431 and the engagement recess 412 of the pressure lever 410 is released, the biasing forces applied to the respective pressure levers 410 by the respective first pressure contact springs 420 are released. The present embodiment is configured such that the pressure contact of the pressure roller 172 on the fixing roller 171 is released at the release position Q2 in the movement direction A.

As shown in FIG. 3, when the pressure roller 172 is to be pressed against the fixing roller 171, the pressure release lever 430 (the shaft part 432) is brought to the pressure position Q1 on the virtual straight line α (α1). That is, the engagement protrusion 431 is engaged with the engagement recess 412 of the pressure lever 410. The biasing force produced by the first pressure contact spring 420 is transmitted to the pressure lever 410 via the pressure release lever 430. As a result, the pressure roller 172 supported by the pressure lever 410 can be pressed toward the fixing roller 171.

As shown in FIG. 4, when the pressure contact between the pressure roller 172 and the fixing roller 171 is to be released, the pressure release lever 430 is operated to cancel the engagement state of the engagement protrusion 431 of the pressure release lever 430 in the engagement recess 412 of the pressure lever 410. By doing so, the engagement protrusion 431 is disengaged from the engagement recess 412. Thereby, the pressure release lever 430 (the shaft part 432) is brought to the release position Q2 on the virtual straight line α (α2). The biasing force of the first pressure contact spring 420 is reduced, and the pressure contact between the pressure roller 172 supported by the pressure lever 410 and the fixing roller 171 is released.

The pressure contact device 400 presses the pressure roller 172 toward the fixing roller 171 with a predetermined pressure contact force by the first pressure contact spring 420, via the pressure lever 410. Also, the pressure contact device 400 releases the pressure contact of the pressure roller 172, which has been pressed against the fixing roller 171 via the pressure lever 410 with the pressure contact force. When the pressure contact between the fixing roller 171 and the pressure roller 172 is released, the biasing force of the first pressure spring 420 is nullified (i.e., becomes zero).

For example, when fixing is to be performed on a thick recording sheet P (P2, see FIG. 4), which is formed to be bag-shaped such as an envelope, with a pressure contact force suitable for performing the fixing on a recording sheet P (P1, see FIG. 3) of standard paper (plain paper), conveyance failure caused by creases, etc., may occur. In order to avoid such failure, the fixing device 17 of the present embodiment should preferably switch the pressure contact force between the fixing roller 171 and the pressure roller 172 between a predetermined first pressure contact force F1 and a predetermined second pressure contact force F2 that is less than the first pressure contact force F1.

When the pair of pressure release levers 430 is at the pressure position Q1 (see FIG. 3), the pressure contact device 400 presses the pressure roller 172 toward the fixing roller 171 with the first pressure contact force F1 by the pair of first pressure contact springs 420. Also, when the pair of pressure release levers 430 is at the release position Q2 (see FIG. 4), the pressure contact device 400 releases the pressure contact of the pressure roller 172 against the fixing roller 171 which is established by the pair of first pressure contact springs 420, and presses the pressure roller 172 toward the fixing roller 171 with the second pressure contact force F2 (<F1) by the pair of second pressure contact springs 450. As described above, the pressure contact device 400 is configured such that when the pressure contact of the pressure roller 172 against the fixing roller 171, which is established by the pair of first pressure contact springs 420, is released, the pair of second pressure contact springs 450 constantly press the pressure roller 172 toward the fixing roller 171 with the second pressure contact force F2.

Accordingly, by bringing the pressure release lever 430 to the pressure position Q1 or the release position Q2 by the operation on the knob portion 434, the pair of first pressure contact springs 420 and the pair of second pressure contact springs 450 can be expanded and contracted. Consequently, pressure applied to the pressure roller 172 with respect to the fixing roller 171 can be increased or decreased.

From the state in which the pair of pressure release levers 430 is at the pressure position Q1 (see FIG. 3), more specifically, the state in which the pressure roller 172 is pressed against the fixing roller 171 by the pair of first pressure contact springs 420 with the first pressure contact force F1, the pair of pressure release levers 430 is moved to the release position Q2 by the operation on the knob portion 434. The pressure roller 172 is pressed against the fixing roller 171 by the pair of second pressure contact springs 450 with the second pressure contact force F2.

On the other hand, from the state in which the pair of pressure release levers 430 is at a second pressure contact position (see FIG. 4), more specifically, the state in which the pressure roller 172 is pressed against the fixing roller 171 by the pair of second pressure contact springs 450 with the second pressure contact force F2, the pair of pressure release levers 430 is brought to the pressure position Q1 by the operation on the knob portion 434, and the pressure roller 172 is pressed against the fixing roller 171 by the first pressure contact springs 420 with the first pressure contact force F1.

Figure 5A:
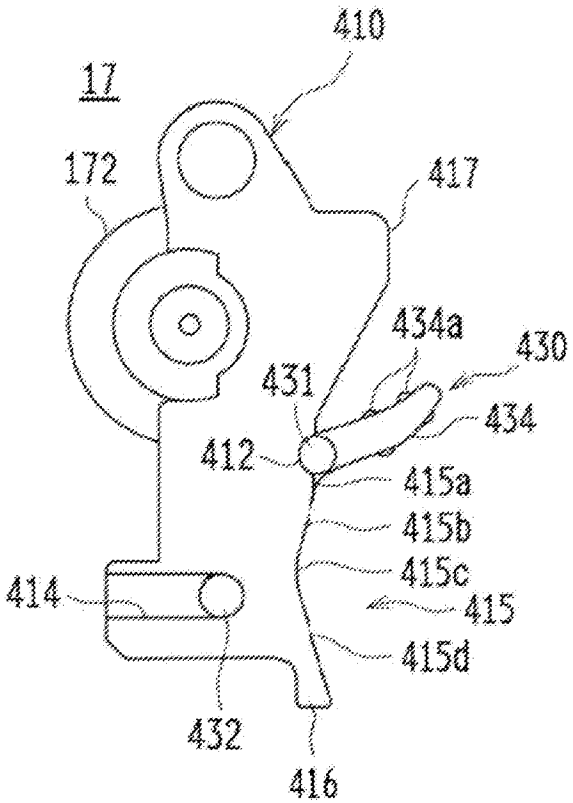
FIGS. 5A to 5C are explanatory views showing the way in which pressure release is performed by one of pressure release levers of a pressure contact device.
Figure 5B:
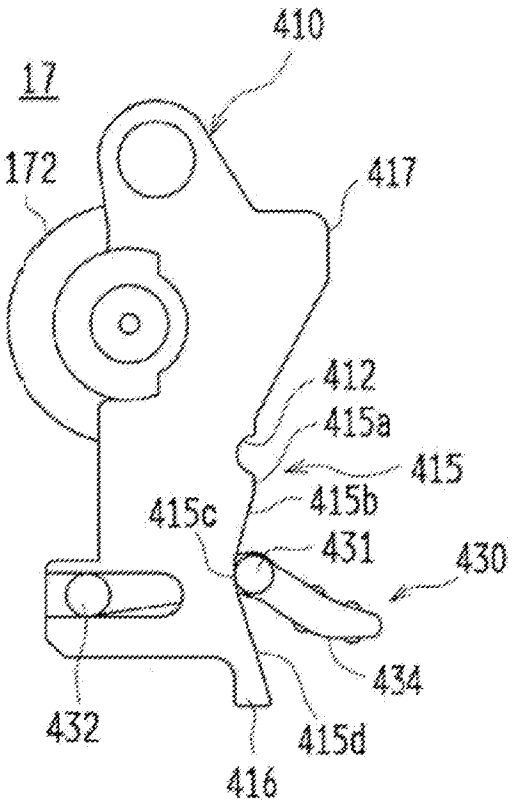
Figure 5C:
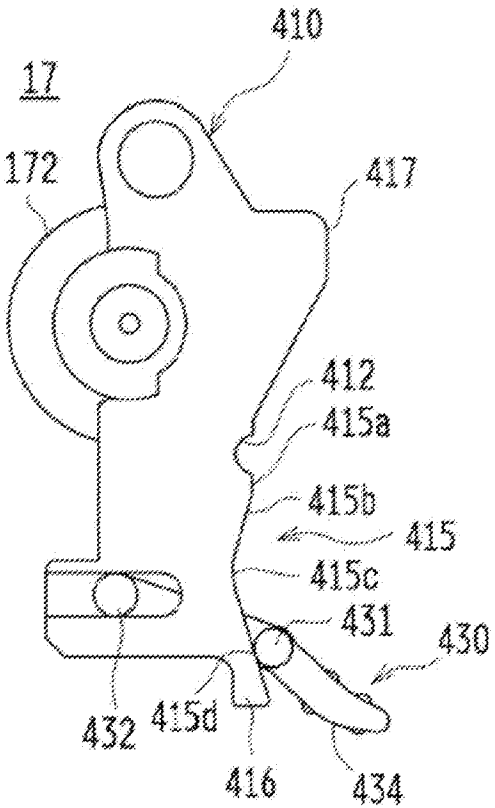

Such a switching operation of the pressure release lever 430 is performed as described below. FIGS. 5A to 5C show the way in which pressure release is performed by the pressure release lever 430 relative to the pressure lever 410, and are explanatory views of the pressure lever 410 and the pressure release lever 430 as seen from one side in the depth direction X.

FIG. 5A shows the state in which the pressure release lever 430 is at the pressure position Q1. The state illustrated is similar to the state shown in FIG. 3, and the engagement protrusion 431 of the pressure release lever 430 is engaged with the engagement recess 412 of the pressure lever 410. The pressure roller 172 is pressed against the fixing roller 171 by the pair of first pressure contact springs 420.

As shown in FIG. 5A, when the pressure release lever 430 is at the pressure position Q1, the knob portion 434 is in an upward posture. As can be seen, the knob portion 434 extends outward from the pressure lever 410, and is provided in such a state that the user can easily hold the knob portion 434 with his/her fingers. Thus, it becomes easy to perform the switching operation of switching the pressure release lever 430 from the pressure position Q1 to the release position Q2.

Next, an operation of holding the knob portion 434, and disengaging the engagement protrusion 431 from the engagement recess 412 is performed. That is, the pair of pressure release levers 430 is lowered. Specifically, the knob portion 434 is pressed downward in the up-and-down direction Z. The engagement protrusion 431 of the pressure release lever 430 is disengaged from the engagement recess 412 of the pressure lever 410, and starts to slide downward along the slidable contact portion 415 by the biasing force of the first pressure contact spring 420. The engagement protrusion 431 of the pressure release lever 430 slides over the first flat portion 415*b* passing through the connection portion 415*a*.

FIG. 5B shows the state in which the pressure release lever 430 is at the release position. The engagement protrusion 431 of the pressure release lever 430 stops at the neutral portion 415*c* of the slidable contact portion 415 where the biasing force of the first pressure contact spring 420 is nullified. The first pressure contact spring 420 is in a pressure release state (a state in which the biasing force is nullified). Also, the pressure roller 172 is pressed against the fixing roller 171 with the second pressure contact force F2 by the biasing force of the second pressure contact spring 450.

Here, as described above, the neutral portion 415*c* provided in the slidable contact portion 415 has a structure not including uneven projections or undulations, for example, which stop the engagement protrusion 431. For this reason, the engagement protrusion 431 which has slid over the first flat portion 415*b* may not be directly positioned at the neutral portion 415*c*, but may slide over the first flat portion 415*b* and reach the second flat portion 415*d* passing through the neutral portion 415*c*.

FIG. 5C shows the way in which the impact of the pressure release lever 430 is mitigated. Although the engagement protrusion 431 which has been disengaged from the engagement recess 412 reaches the neutral portion 415*c* by the biasing force of the first pressure contact spring 420, since the neutral portion 415*c* does not have a structure for stopping the engagement protrusion 431, the engagement protrusion 431 keeps on sliding to the second flat portion 415*d*.

Here, in the second flat portion 415*d*, the biasing force of the first pressure contact spring 420 is gradually increased. Also, the pressure lever 410 is provided with the extension portion 416, and thus, a longer sliding distance is secured for the second flat portion 415*d* as compared to the first flat portion 415*b*. Consequently, the engagement protrusion 431 changes a sliding direction thereof without sliding to an end portion of the extension portion 416 (i.e., a lower end portion of the slidable contact portion 415). The engagement protrusion 431 which has slid beyond the neutral portion 415*c* slides in a direction of returning to the neutral portion 415*c* from the second flat portion 415*d* without dropping out of the slidable contact portion 415.

Also, even if the engagement protrusion 431 slides in the direction of returning to the neutral portion 415*c* (i.e., in an upper direction in the drawing along the slidable contact portion 415 in FIG. 5C), passes through the neutral portion 415*c*, and starts to slide over the first flat portion 415*b*, the biasing force of the first pressure contact spring 420 increases. For this reason, the engagement protrusion 431 is prevented from sliding over the connection portion 415*a* upward, or returning to the engagement recess 412. Eventually, the engagement protrusion 431 is to be located at the neutral portion 415*c*.

As described above, during a period in which the state as shown in FIG. 5A (i.e., pressure position Q1) is shifted to the state shown in FIG. 5B (i.e., release position Q2) by way of the state shown in FIG. 5C, the engagement protrusion 431 moves smoothly along the slidable contact portion 415 of the pressure lever 410. Thus, there is no part which makes a sudden action, and collision or the like with the pressure lever 410 does not occur. Accordingly, the operation of the engagement protrusion 431 does not generate a collision sound or an impact sound, and is performed extremely smoothly and stably.

On the contrary, when the state is to be switched from the pressure release state to the pressure state, since the knob portion 434 of the pressure release lever 430 at the release position Q2 is in the downward posture, the user can easily move the knob portion 434 upward in the up-and-down direction Z with his/her fingers. Thus, the switching operation of switching the position from the release position Q2 to the pressure position Q1 can also be easily performed.

Case of Fixing Operation on Recording Sheet P1 of Standard Paper

For example, in the case of performing a fixing operation on the recording sheet P (P1) of standard paper, as shown in FIG. 3, the pressure release lever 430 is brought to the pressure position Q1, and the pressure roller 172 is pressed toward the fixing roller 171 with the first pressure contact force F1 by the biasing force of the first pressure contact spring 420.

Case of Fixing Operation on Thick Recording Sheet P2

For example, in the case of performing a fixing operation on a thick recording sheet P (P2) which is formed to be bag-shaped such as an envelope, the pressure release lever 430 is brought to the release position Q2, as shown in FIG. 4. In doing so, even if the pressure release lever 430 is operated, no impact sound or collision sound is generated. Thus, in addition to suppressing vibrations, etc., to be conveyed to each member of the fixing device 17, the pressure release lever 430 can be operated at ease. By the above feature, the first pressure contact spring 420 is set to the pressure release state (i.e., the state in which the biasing force is nullified), and the pressure roller 172 is pressed toward the fixing roller 171 with the second pressure contact force F2 by the biasing force of the second pressure contact spring 450.

Embodiment 2

The fixing device 17 can bring the fixing roller 171 and the pressure roller 172 to be pressed against each other, and release such pressure contact by means of the pressure contact device 400. In the pressure contact device 400, a configuration of the pressure lever 410 which contributes to realizing the pressure contact state of the pressure roller 172 on the fixing roller 171 is not limited to the configuration indicated in Embodiment 1 described above. That is, the pressure contact device 400 may be embodied by providing similar functions in the other various forms.

Figure 6:
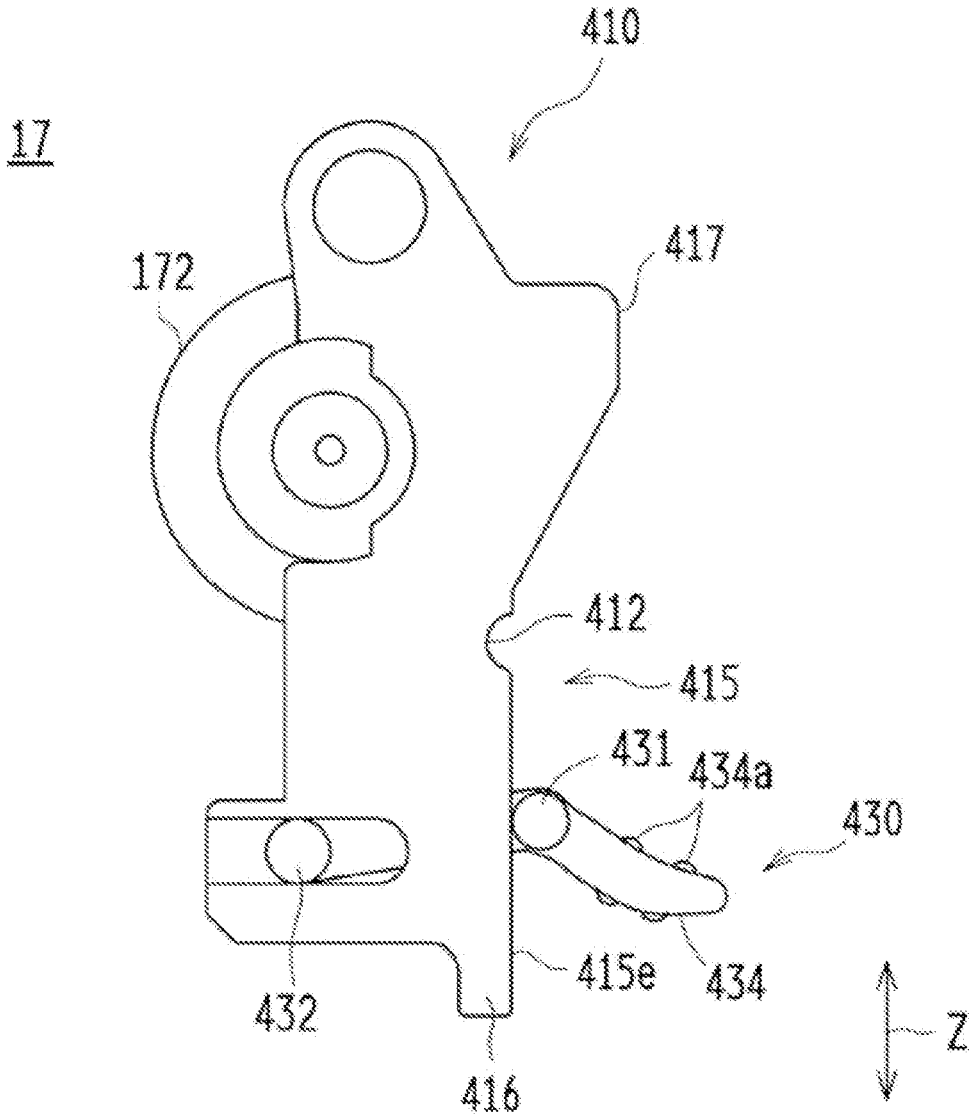
FIG. 6 is an explanatory view showing a pressure lever and a pressure release lever in a fixing device according to Embodiment 2, and is a view corresponding to FIG. 5B.

As an example, a pressure lever 410 of a pressure contact device 400 shown in FIG. 6 has commonality with that of the above Embodiment 1 in that the pressure lever 410 includes a slidable contact portion 415 adjacent to an engagement recess 412. However, the pressure lever 410 of this example is featured in the shape of the slidable contact portion 415. Since the other structures of the pressure lever 410 of the pressure contact device 400, a first pressure contact spring 420, and a pressure release lever 430 have commonality with those of the above Embodiment 1, common structures are indicated by the same reference numerals and explanation of such common structures is omitted. Here, the structure of the slidable contact portion 415 will be described in detail.

As shown in FIG. 6, in the pressure lever 410 of the pressure contact device 400 according to the present embodiment, the slidable contact portion 415 is formed as a flat slidable contact surface 415*e* not including undulations. The flat slidable contact surface 415*e* is adjacent to the engagement recess 412, and is provided continuously to an extension portion 416 of the pressure lever 410. In this case, an angle of the slidable contact surface 415*e*, which corresponds to an angle formed between the first flat portion 415*b* and the second flat portion 415*d* of Embodiment 1, is formed to be a straight angle. The slidable contact surface 415*e* is formed continuously without any distinction of the first flat portion 415*b*, the neutral portion 415*c*, and the second flat portion 415*d*.

By the above feature, even with the fixing device 17 according to Embodiment 2, a similar advantage can be brought about. More specifically, when an engagement protrusion 431 is to be slid by the biasing force of the first pressure contact spring 420 between a state in which the pressure release lever 430 is at a pressure position Q1 and a state in which the pressure release lever 430 is at a release position Q2, the slidable contact portion 415 does not include any part which makes a sudden action, and does not cause collision or the like, as in the above Embodiment 1. Consequently, the engagement protrusion 431 can move smoothly along the slidable contact portion 415 of the pressure lever 410, without generating a collision sound or an impact sound.

As described above, in the fixing device 17 and the image forming apparatus 100 according to the present disclosure, even if the pressure release lever 430 is operated at the time of switching operation of the pressure release lever 430, no impact sound or collision sound is generated. It is possible to suppress vibrations, etc., to be conveyed to each part of the fixing device 17, and also operate pressure release lever 430 at ease.

Note that in Embodiments 1 and 2 above, a fixing roller is used as the first fixing member and a pressure roller is used as the second fixing member. However, a pressure roller may be used as the first fixing member and a fixing roller may be used as the second fixing member. Also, as one of the first fixing member and the second fixing member, an element comprising a plurality of rollers including a fixing roller (for example, a fixing roller and a heating roller), and an endless fixing belt wound around the plurality of rollers may be used. Further, as the other one of the first fixing member and the second fixing member, a pressure roller which is pressed against the fixing roller with the fixing belt interposed therebetween may be used.

Further, in the present embodiment, the fixing device 17 is configured such that the pressure lever 410 is pivoted about the pivoting fulcrum 175. However, the fixing device 17 may be configured such that the pressure lever 410 is moved in a linear direction of applying pressure to or releasing pressure from the pressure roller 172 (i.e., a linear direction in which the pressure roller 172 approaches the fixing roller 171 or moves away from the fixing roller 171).

The present invention is not limited to the embodiments described above, and can be implemented in various other forms. Accordingly, the embodiments described are merely illustrations in all respects, and should not be interpreted in a limited way. The scope of the present invention is defined by the appended claims, and is in no way confined by the descriptions of the specification. Furthermore, modifications and changes deemed to be the equivalents of the claims all fall within the scope of the claims of the present invention.

What is claimed is:

1. A fixing device comprising:

a first fixing member and a second fixing member that are opposed to each other;

a supporter which supports the first fixing member and the second fixing member to be contactable with or separable from each other;

a biasing member which biases the supporter in a pressure contact direction, which is a direction in which the first fixing member and the second fixing member are pressed; and a releaser which releases pressure contact between the first fixing member and the second fixing member, the releaser moving relatively with respect to the supporter along a predetermined movement direction to actuate the biasing member, wherein the supporter includes an engagement recess which holds the releaser at a pressure position where the biasing member is actuated, and the releaser includes an engagement protrusion which is engageable with the engagement recess, the supporter further includes a slidable contact portion adjacent to the engagement recess, the releaser enables biasing intensity of the biasing member to be increased or decreased as the engagement protrusion is slid along the slidable contact portion by a biasing force of the biasing member between a state in which the releaser is at the pressure position and a state in which the releaser is at a release position for releasing the pressure contact, the slidable contact portion includes: a first flat portion extending in a direction of reducing the biasing force of the biasing member; a neutral portion which is continuous with the first flat portion and at which the biasing force of the biasing member is minimized; and a second flat portion extending further beyond the neutral portion; and an angle formed between the first flat portion and the second flat portion is an obtuse angle or a straight angle.

2. The fixing device according to claim 1, wherein the slidable contact portion is formed to hold the releaser at the release position in the neutral portion.

3. The fixing device according to claim 1, wherein the first flat portion is provided between the engagement recess and the neutral portion, and is inclined in the direction of reducing the biasing force of the biasing member.

4. The fixing device according to claim 1, wherein the second flat portion is provided continuously to be successive to the first flat portion and the neutral portion, and is inclined in a direction of increasing the biasing force of the biasing member.

5. The fixing device according to claim 4, wherein the second flat portion is provided with a flat surface that is greater in length than a flat surface between the engagement recess and the neutral portion.

6. The fixing device according to claim 4, wherein the second flat portion includes an extension portion projected from an end portion of the supporter, and extending in a direction of being away from the first fixing member and the second fixing member.

7. An image forming apparatus comprising the fixing device according to claim 1.

* * * * *